US006217005B1

(12) United States Patent
Scott

(10) Patent No.: US 6,217,005 B1
(45) Date of Patent: Apr. 17, 2001

(54) LOAD LIFTING AND SUPPORTING DEVICE

(76) Inventor: John J. Scott, 83 Woodstone La., Villanova, PA (US) 19085

( * ) Notice: Subject to any disclaimer, the term of this patent is extended or adjusted under 35 U.S.C. 154(b) by 0 days.

(21) Appl. No.: 09/388,955

(22) Filed: Sep. 2, 1999

(51) Int. Cl.[7] ..... B66F 3/36
(52) U.S. Cl. ..... 254/100
(58) Field of Search ..... 254/98, 100, 133 A

(56) References Cited

U.S. PATENT DOCUMENTS 1,350,970 * 8/1920 Hutchison et al. ..... 254/DIG. 1
2,617,620 * 11/1952 Jessop ..... 254/98
5,971,362 * 10/1999 Clark ..... 254/100

* cited by examiner

*Primary Examiner*—Robert C. Watson

(57) ABSTRACT

A load lifting and supporting device for leveling beams and other adjustable compressive load applications. The load lifting and supporting device includes a housing with opposite ends, a longitudinal axis extending between the ends, a threaded bore extending therethrough along the longitudinal axis, and an outer surface. A pair of opposed extension members each have a threaded portion and a head portion. The threaded portions are threadedly received in the threaded bore of the housing and are extendible therefrom.

9 Claims, 3 Drawing Sheets

LOAD LIFTING AND SUPPORTING DEVICE

BACKGROUND OF THE INVENTION

1. Field of the Invention

The present invention relates to jacks and more particularly pertains to a new load lifting and supporting device for leveling beams and other adjustable compressive load applications.

2. Description of the Prior Art

The use of jacks is known in the prior art. More specifically, jacks heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,973,185; U.S. Pat. No. 3,667,730; U.S. Pat. No. 4,556,200; U.S. Pat. No. 5,125,280; U.S. Pat. No. 2,734,726; and U.S. Pat. No. 252,555.

While these devices fulfill their respective, particular objectives and requirements, the aforementioned patents do not disclose a new load lifting and supporting device. The inventive device includes a housing with opposite ends, a longitudinal axis extending between the ends, a threaded bore extending therethrough along the longitudinal axis, and an outer surface. A pair of opposed extension members each have a threaded portion and a head portion. The threaded portions are threadedly received in the threaded bore of the housing and are extendible therefrom.

In these respects, the load lifting and supporting device according to the present invention substantially departs from the conventional concepts and designs of the prior art, and in so doing provides an apparatus primarily developed for the purpose of leveling beams and other adjustable compressive load applications.

SUMMARY OF THE INVENTION

In view of the foregoing disadvantages inherent in the known types of jacks now present in the prior art, the present invention provides a new load lifting and supporting device construction wherein the same can be utilized for leveling beams and other adjustable compressive load applications.

The general purpose of the present invention, which will be described subsequently in greater detail, is to provide a new load lifting and supporting device apparatus and method which has many of the advantages of the jacks mentioned heretofore and many novel features that result in a new load lifting and supporting device which is not anticipated, rendered obvious, suggested, or even implied by any of the prior art jacks, either alone or in any combination thereof.

To attain this, the present invention generally comprises a housing with opposite ends, a longitudinal axis extending between the ends, a threaded bore extending therethrough along the longitudinal axis, and an outer surface. A pair of opposed extension members each have a threaded portion and a head portion. The threaded portions are threadedly received in the threaded bore of the housing and are extendible therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new load lifting and supporting device apparatus and method which has many of the advantages of the jacks mentioned heretofore and many novel features that result in a new load lifting and supporting device which is not anticipated, rendered obvious, suggested, or even implied by any of the prior art jacks, either alone or in any combination thereof.

It is another object of the present invention to provide a new load lifting and supporting device which may be easily and efficiently manufactured and marketed.

It is a further object of the present invention to provide a new load lifting and supporting device which is of a durable and reliable construction.

An even further object of the present invention is to provide a new load lifting and supporting device which is susceptible of a low cost of manufacture with regard to both materials and labor, and which accordingly is then susceptible of low prices of sale to the consuming public, thereby making such load lifting and supporting device economically available to the buying public.

Still yet another object of the present invention is to provide a new load lifting and supporting device which provides in the apparatuses and methods of the prior art some of the advantages thereof, while simultaneously overcoming some of the disadvantages normally associated therewith.

Still another object of the present invention is to provide a new load lifting and supporting device for leveling beams and other adjustable compressive load applications.

Yet another object of the present invention is to provide a new load lifting and supporting device which includes a housing with opposite ends, a longitudinal axis extending between the ends, a threaded bore extending therethrough along the longitudinal axis, and an outer surface. A pair of opposed extension members each have a threaded portion and a head portion. The threaded portions are threadedly received in the threaded bore of the housing and are extendible therefrom.

Still yet another object of the present invention is to provide a new load lifting and supporting device that are small enough to be used where standard sized jacks would not fit.

Even still another object of the present invention is to provide a new load lifting and supporting device that may include plates to spread the load out from the head portions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
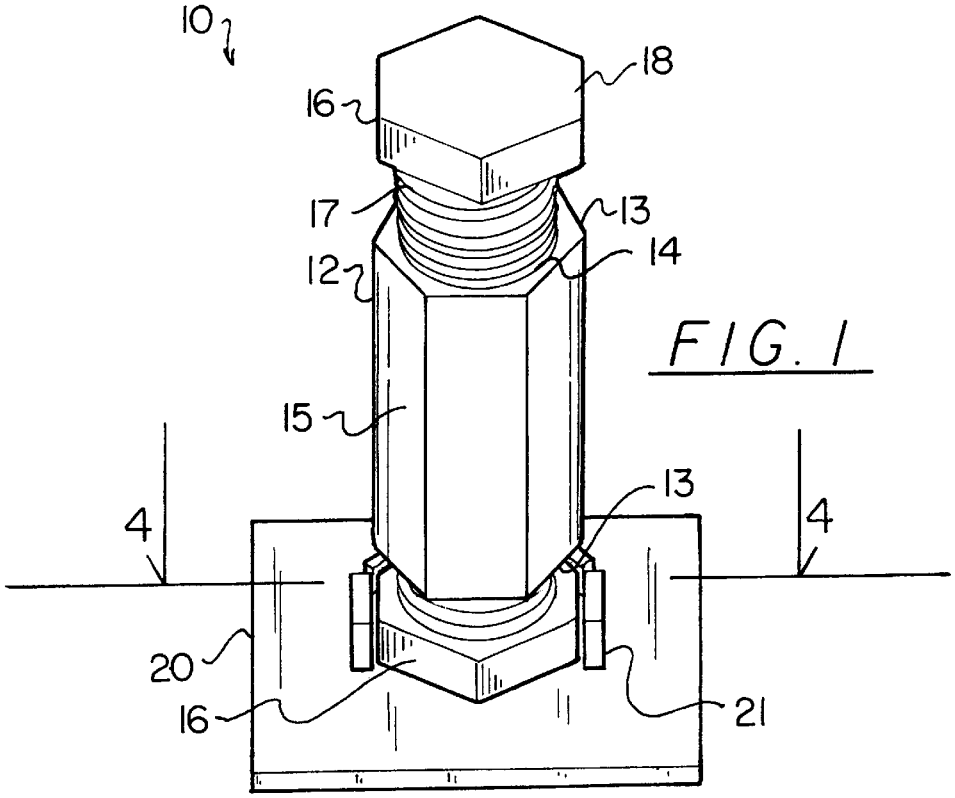
FIG. 1 is a schematic perspective view of a new load lifting and supporting device according to the present invention.

With reference now to the drawings, and in particular to FIGS. 1 through 6 thereof, a new load lifting and supporting device embodying the principles and concepts of the present invention and generally designated by the reference numeral 10 will be described.

As best illustrated in FIGS. 1 through 4, the load lifting and supporting device 10 generally comprises a housing 12 with opposite ends 13, a longitudinal axis extending between the ends, a bore 14 extending through the housing along the longitudinal axis, and an outer surface 15. The bore includes two sets of threads, each set extending inwardly along the bore from a respective end of the housing. A pair of opposed extension members 16 each have a threaded portion 17 and a head portion 18. The threaded portion of one of the extension members has right hand threads and is receivable in the first set of threads of the bore. The threaded portion of the other extension member has left hand threads and is receivable in the second set of threads. The threaded portions are threadedly received in the bore of the housing such that the rotation of the housing urges the head portion of each of extension members to advance in opposing directions therefrom.

Figure 2:
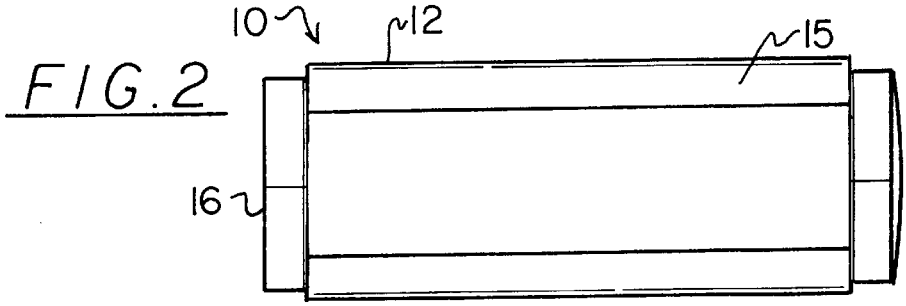
FIG. 2 is a schematic side view of a hexagonal version of the present invention.
Figure 3:
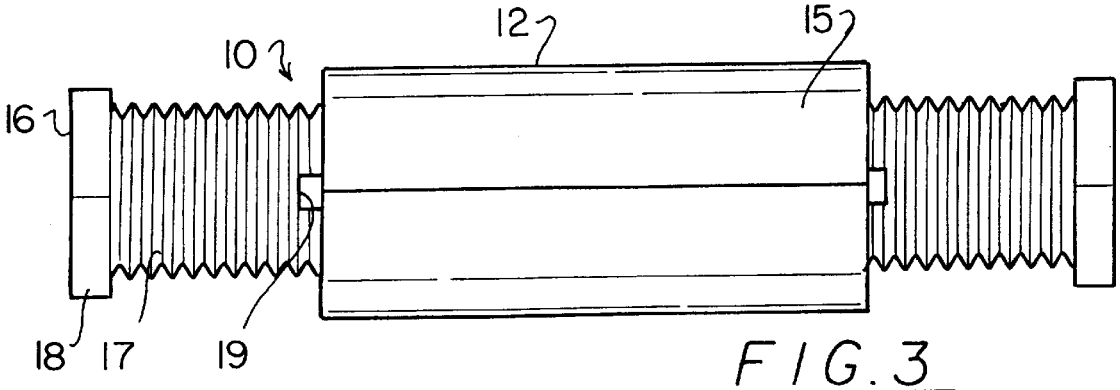
FIG. 3 is a schematic side view of a rectangular version of the present invention.

Preferably, the outer surface has a polygonal transverse cross section taken perpendicular to the longitudinal axis of the housing for nonrotatably receiving a tool such as a wrench therearound. FIGS. 1 and 2 show a hexagonal configuration of the housing. FIG. 3 shows a generally square configuration of the housing.

Preferably, the head portions of each of the extension members has a polygonal periphery. FIGS. 1 and 2 show a hexagonal configuration of the head portion.

Also preferably, the threaded portions of each of the extension members has a warning slot 19 extending diametrically therethough into a free end thereof for indicating that the free ends are positioned towards the ends of the housing so that a user sees the warning slot and stops rotating the housing or extension member so the user doesn't screw the extension members out of the bore.

A pair of base plates 20 rest on the head portions for helping prevent rotation of the head portions and to provide for a greater load bearing surface. Each of the base plates has a plurality of flanges 21 extending therefrom in a semicircular arrangement such that more than slight rotation of the head portions is prevented. See FIGS. 1 and 4.

Ideally, each of the base plates has a plurality of protuberances 22 extending therefrom opposite the flanges for helping prevent rotation of the base plates with respect to an object engaging the base plates.

Optionally, an outer surface of one of the head portions is rounded for reducing friction between the head portion and an object. This would be used where very precise lifting and positioning is required. A base plate would be placed under the second head portion. The housing would be rotated while the first head portion is held with another tool such that rotation of the first head portion is prevented. When the first head portion engages the object to be supported or a ground surface, the housing is held and the first head portion is rotated, or the first head portion is held and the housing rotated, to extend or retract the first head portion from the housing. Thus, a wrench would have to move twice the distance to lift the object.

In use, the invention is placed between a ground or base surface and the object to be lifted. Rotation of the housing in a first direction with respect to the extension members extends the extension members out of the housing to lift the object. Rotation of the housing in a second direction with respect to the extension members retracts the extension members towards the housing to lower the object.

Figure 5:
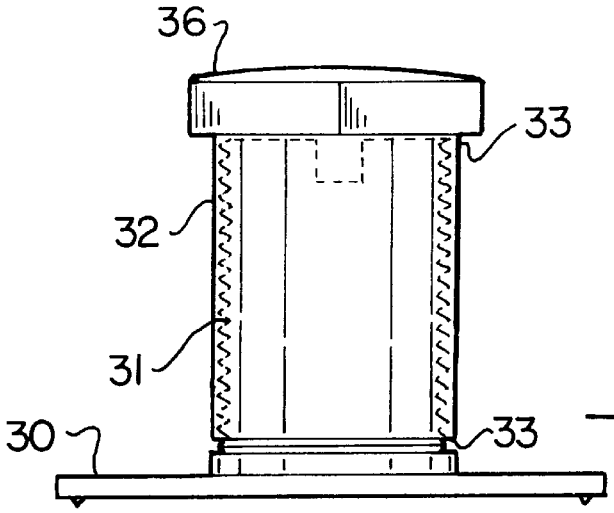
FIG. 5 is a schematic side view of an alternate embodiment of the present invention.
Figure 4:
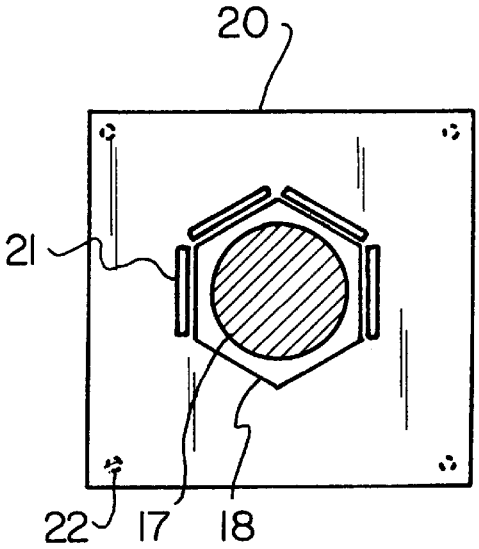
FIG. 4 is a schematic top view of a base plate of the present invention.
Figure 6:
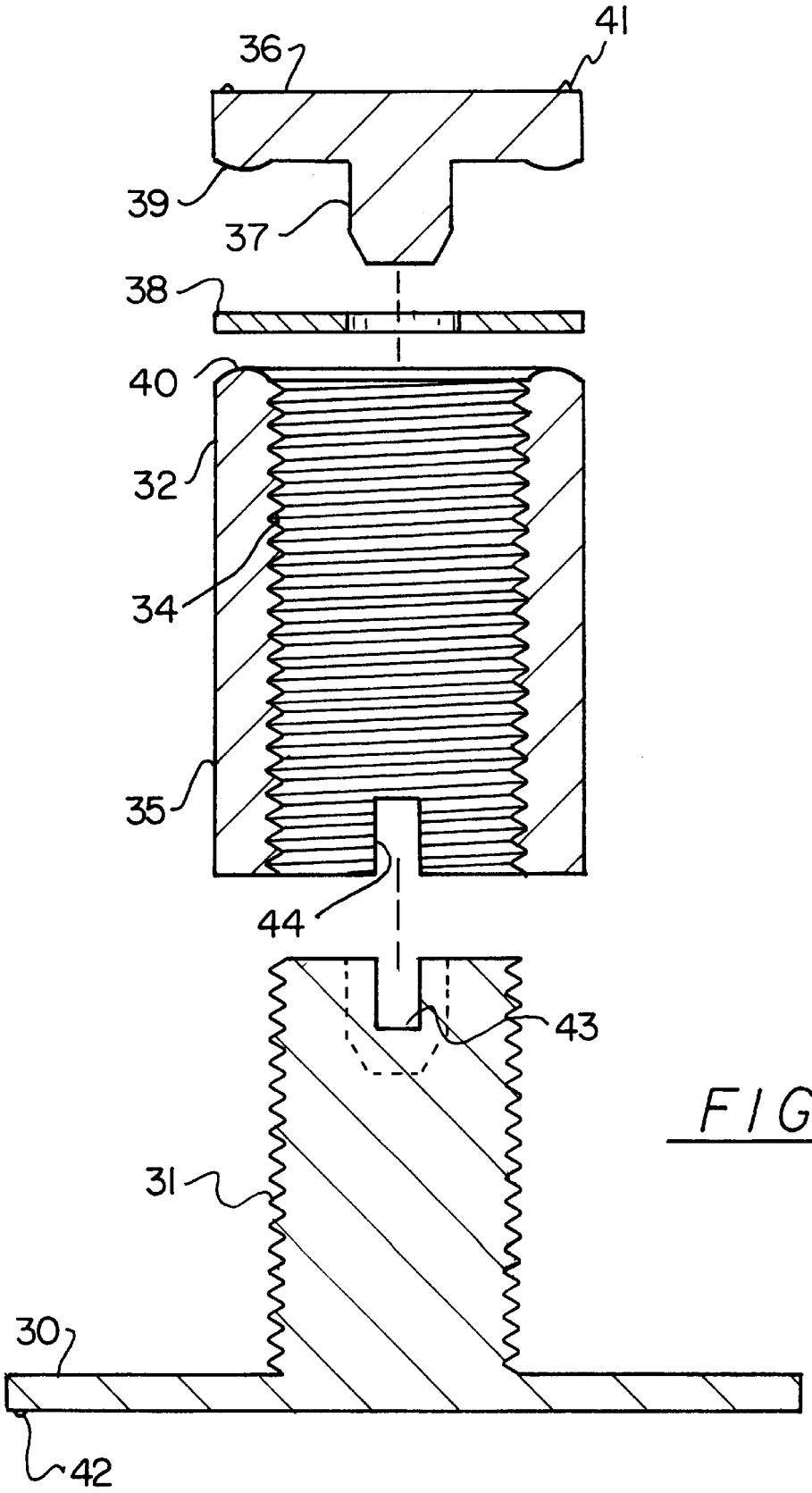
FIG. 6 is a schematic exploded view of the alternate embodiment of the present invention.

In a second embodiment, shown in FIGS. 5 and 6, a base panel 30 has a threaded portion 31 upwardly extending therefrom.

A sleeve 32 has opposite ends 33, a longitudinal axis extending between the ends, a threaded bore 34 extending therethrough along the longitudinal axis, and an outer surface 35. The threaded portion of the base panel is threadedly inserted in the threaded bore of the sleeve.

Preferably, the outer surface of the sleeve has a polygonal transverse cross section taken perpendicular to the longitudinal axis of the sleeve for nonrotatably receiving a tool such as a wrench therearound. The outer surface of the sleeve can have the same general shape as those shown in FIGS. 1 and 2 that show a hexagonal configuration of the sleeve.

A head member 36 rests on the sleeve. The head member has an arm portion 37 extending therefrom that is rotatably inserted in the bore of the sleeve.

Preferably, a soft metal washer 38 is disposed between the sleeve and the head member to act as a bearing between the head member and the sleeve. Exemplary materials of the washer are lead and copper.

More preferably, the head member has an annular protruding portion 39 extending therefrom about the arm portion. An upper end 40 of the sleeve is rounded and generally aligned with the protruding portion of the head member. The rounded parts reduce the surface area rubbing the washer, thereby reducing frictional resistance even more.

Ideally, the head member has a plurality of protuberances 41 extending therefrom opposite the arm portion for helping prevent rotation of the head member with respect to an object engaging the head member.

Ideally, the base member has a plurality of protuberances 42 extending therefrom opposite the threaded portion for helping prevent rotation of the base plates with respect to an object engaging the base plates.

Preferably, the sleeve has a longitudinal length about equal to a longitudinal length of the threaded portion, the threaded portion has a cavity extending into a free end thereof adapted for receiving the arm portion of the head member.

Also preferably, the threaded portion of the base panel has a warning slot 43 extending diametrically therethough into a free end thereof for indicating that the free end is positioned towards an end of the sleeve so that a user doesn't screw the sleeve off of the threaded portion. The sleeve has a warning slot 44 extending diametrically therethough into a free end thereof.

Optionally, an outer surface the head portion is rounded for reducing friction between the head portion and an object. The head member would have a polygonal periphery. This would be used where very precise lifting and positioning is required. A base plate would be placed under the second head portion. The sleeve would be rotated while the first head portion is held with another tool. When the first head portion engages the other object to be supported or ground surface, the sleeve is held and the first head portion is rotated to extend it from the sleeve. Thus, a wrench would have to move twice the distance to lift the object.

In use, the invention is placed between a ground or base surface and the object to be lifted. The sleeve is rotated in a first direction with respect to the base panel to extend the sleeve away from the base panel. The sleeve is rotated in a second direction with respect to the base panel to retract the sleeve towards the base panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A load supporting device, comprising:

a housing having opposite ends, a longitudinal axis extending between said opposite ends, a bore extending through said housing along said longitudinal axis, and an outer surface;

said bore having two sets of threads, each of said sets of threads extending inwardly along said bore from a respective end of said housing;

a pair of opposed extension members each having a threaded portion and a head portion, said threaded portion of a first one of said pair of extension members having right hand threads, said threaded portion of a second one of said pair of said extension members having left hand threads, each of said threaded portions being threadably received in a respective one of said sets of threads of said bore of said housing and being extendable therefrom; and a pair of base plates, each base plate being removably positionable against one of said head portions for abutting against a surface, each of said base plates having a plurality of flanges extending therefrom for surrounding said head portion when positioned against said base plate to resist rotation of said portion with respect to said base plate, said plurality of flanges defining a gap therebetween, said gap permitting lateral movement of said head portion in a single direction with respect to said base plate.

2. The load supporting device of claim 1, wherein said outer surface has a polygonal transverse cross section taken perpendicular to said longitudinal axis of said housing for receiving a tool therearound.

3. The load supporting device of claim 1, wherein said head portions of each of said extension members has a polygonal periphery.

4. The load supporting device of claim 1, wherein said threaded portions of each of said extension members has a warning slot extending diametrically therethough into a free end thereof for indicating that said free ends are positioned towards said ends of said housing.

5. The load supporting device of claim 1, wherein each of said head portion of each of said extension members has a hexagonal periphery.

6. The load supporting device of claim 1, wherein said polygonal transverse cross section of said outer surface is hexagonal.

7. The load supporting device of claim 5, wherein the flanges of each of said base plates are configured to be positioned adjacent and parallel to a side of said hexagonal periphery of said head portion adjacent to said base plate.

8. The load supporting device of claim 7, wherein said plurality of said flanges comprises four flanges.

9. The load supporting device of claim 8, wherein two of said flanges are oriented parallel to each other.

* * * * *